US005419007A

United States Patent [19]

Hult et al.

[11] Patent Number: 5,419,007

[45] Date of Patent: May 30, 1995

[54] SNAP TOGETHER WET NOZZLE

[75] Inventors: David R. Hult, St. Peters; Stuart V. Holsten, O'Fallon; George P. Tyree, Creve Coeur, all of Mo.

[73] Assignee: Emerson Electric Co., St. Louis, Mo.

[21] Appl. No.: 167,137

[22] Filed: Dec. 16, 1993

[51] Int. Cl.[6] ..... A47L 7/00; A47L 9/06

[52] U.S. Cl. ..... 15/401; 15/245

[58] Field of Search ..... 15/245, 401

[56] References Cited

U.S. PATENT DOCUMENTS

| | | | |
|---|---|---|---|
| 2,844,841 | 7/1958 | Bergquist | 15/417 |
| 2,857,615 | 10/1958 | Anderson | 15/373 |
| 2,867,835 | 1/1959 | Brown, Jr. et al. | 15/328 |
| 3,029,461 | 4/1962 | Osborn | 15/320 |
| 3,107,387 | 10/1963 | Katt | 15/401 X |
| 3,210,792 | 10/1965 | Sassano | 15/401 |
| 3,571,841 | 3/1971 | Crouser | 15/401 |
| 3,584,330 | 6/1971 | Wallin et al. | 15/401 X |
| 3,950,813 | 4/1976 | Buck | 15/245 |
| 4,124,915 | 11/1978 | Schlicher | 15/245 X |
| 4,864,681 | 9/1989 | Hult et al. | 15/367 |
| 5,184,372 | 2/1993 | Mache | 15/401 |

*Primary Examiner*—Christopher K. Moore

*Attorney, Agent, or Firm*—Polster, Lieder, Woodruff & Lucchesi

[57] ABSTRACT

A snap together wet nozzle for use with a vacuum cleaner is disclosed. The snap together wet nozzle includes an elongated U-shaped nozzle housing with closed ends including a connecting tube passageway for association with the vacuum cleaner. An elongated squeegee is mounted within the elongated U-shaped housing and is held in releasable locking engagement between a locking squeegee bar and the elongated U-shaped housing. The locking squeegee bar has a plurality of spaced squeegee prongs for reception within spaced complementary configuring openings in the elongated squeegee element, the spaced squeegee prongs being cooperatively engaged by a plurality of spaced prong receptacles formed in the elongated U-shaped nozzle housing. Complementary releasable locking means are associated with the elongated U-shaped nozzle housing and the locking squeegee bar for releasably holding the locking squeegee bar and associated elongated squeegee element relative to the elongated U-shaped nozzle housing.

9 Claims, 2 Drawing Sheets

SNAP TOGETHER WET NOZZLE

BACKGROUND OF THE INVENTION

The present invention relates to a wet nozzle for use with a vacuum cleaner, and more particularly, to a snap together wet nozzle for use with a vacuum cleaner.

Wet nozzles for vacuum cleaners are typically provided with an elongated squeegee element that is mounted within an elongated nozzle housing. Passageways are provided on each side of the squeegee element in order to enable both air and water to pass around the squeegee element, when drawn by a vacuum cleaner through the elongated nozzle housing.

One typical prior art design is shown in FIG. 1 of the drawings. There, it will be seen that the elongated squeegee element is captured between complementary halves of a squeegee bar assembly. The combined squeegee bar assembly, including the squeegee element and complementary halves of the squeegee bar, are inserted and securely retained within the elongated nozzle housing. While this typical prior art design has worked quite well, there are numerous improved features and advantages over such prior art design in the snap together wet nozzle device of the present invention, as will become apparent from the discussion that follows.

SUMMARY OF THE INVENTION

Among the several objects and advantages of the present invention include:

- The provision of a new and improved snap together wet nozzle for use with a vacuum cleaner;
- The provision of the aforementioned snap together wet nozzle which enables the snap together construction to be assembled immediately following the molding of an elongated nozzle housing;
- The provision of the aforementioned snap together wet nozzle which enables a squeegee element to be trapped between an elongated nozzle housing and squeegee bar in a novel and unique manner;
- The provision of the aforementioned snap together wet nozzle in which the squeegee element is symmetrical, thus eliminating the need to orient the squeegee element during assembly;
- The provision of the aforementioned snap together wet nozzle which can be simply and easily constructed; is easy to assemble following the mold cycle; facilitates separation for replacement of the squeegee element; is made of a minimum number of parts; is durable and long lasting, and is otherwise well adapted for the purposes intended.

Briefly stated, the snap together wet nozzle of the present invention is adapted for use with a vacuum cleaner. The snap together wet nozzle includes an elongated U-shaped nozzle housing with closed ends including a connecting tube passageway for association with the vacuum cleaner. An elongated squeegee element is mounted within the elongated U-shaped housing and is releasably held and locked between a locking squeegee bar and the elongated U-shaped nozzle housing.

The locking squeegee bar has a plurality of spaced squeegee prongs for reception within spaced complementary configured openings in the elongated squeegee element. The plurality of spaced squeegee prongs of the locking squeegee bar are cooperatively engaged by a plurality of spaced prong receptacles formed in the elongated U-shaped nozzle housing. The plurality of spaced prong receptacles are formed along one inner wall of the U-shaped nozzle housing.

Spaced steps are formed along the inner wall of the nozzle housing adjacent to and in alignment with the spaced prong receptacles for supporting the elongated squeegee element above the inner wall of the U-shaped nozzle housing containing the spaced prong receptacles. Each of the spaced prongs further including shoulders for supporting the elongated squeegee element from the locking squeegee bar. This enables air and water to pass around the squeegee element and through the tube passageway associated with the elongated U-shaped nozzle housing.

Complementary releasable locking means are associated with the elongated U-shaped nozzle housing and the locking squeegee bar. The complementary releasable locking means of the locking squeegee bar cooperatively engage complementary releasable locking means of the elongated U-shaped nozzle on opposite spaced outer walls thereof. The complementary releasable locking means include upper and lower locking elements which engage each other along the outer walls of the elongated U-shaped nozzle housing. At least the upper locking elements include releasable locking means.

These and other further objects of the present invention will become apparent from the more detailed description of the invention that follows.

BRIEF DESCRIPTION OF THE DRAWINGS

In the drawings.

Corresponding reference numerals will be used throughout the various figures of the drawings.

DESCRIPTION OF THE PREFERRED EMBODIMENT

The following detailed description illustrates the invention by way of example and not by way of limitation. This description will clearly enable one skilled in the art to make and use the invention, describes several embodiments, adaptions, variations, alternatives and uses of the invention, including what we presently believe is the best mode of carrying out the invention.

Figure 1:
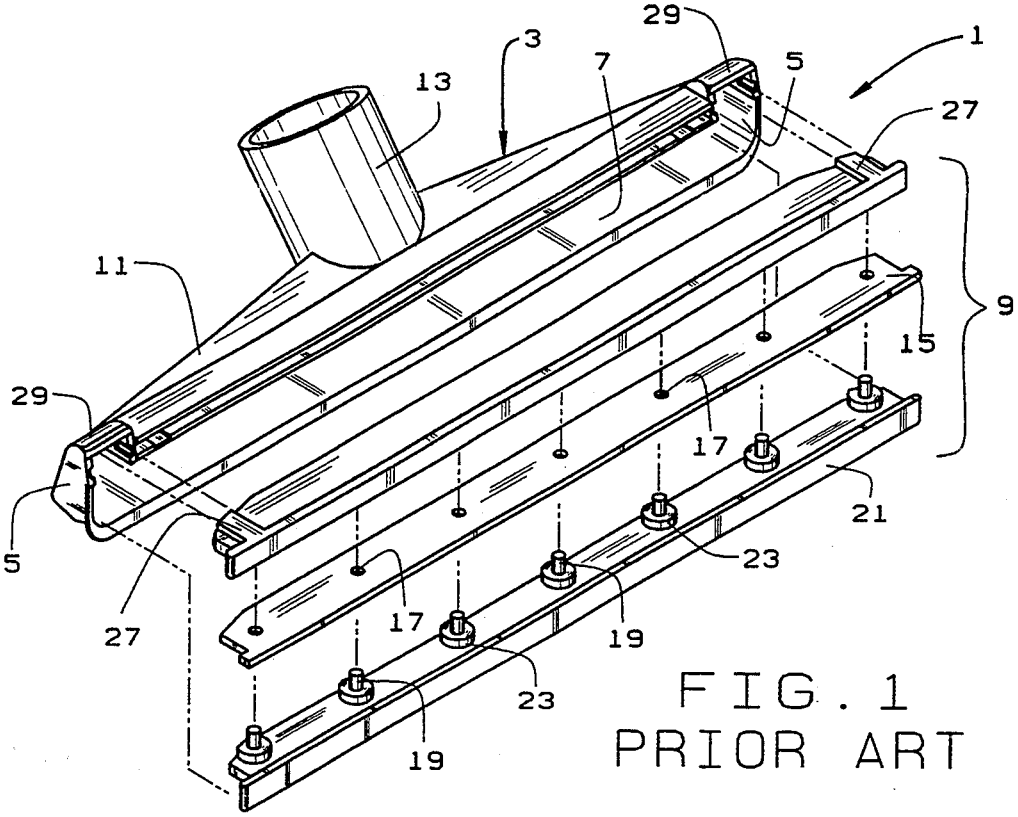
FIG. 1 PRIOR ART
FIG. 1 is an exploded perspective view of one typical prior art wet nozzle construction with which the present invention is specifically compared.

In order to provide a background understanding of the improved features and advantages of the snap together wet nozzle of the present invention as compared to the prior art, reference is first made to FIG. 1 of the drawings which shows one typical prior art construction. The prior art wet nozzle 1 of the prior art construction shows an elongated U-shaped nozzle housing 3 with closed ends 5. The open portion 7 of the elongated U-shaped nozzle housing 3 is adapted to receive the squeegee bar assembly 9, as will be presently described. Opposite from the open portion or area 7 of the elongated U-shaped nozzle housing 3 is a closed wall or section 11 shown to taper from each of the closed ends 5 upwardly to a tubular portion 13 which forms a connecting passageway for association with a vacuum cleaner (not shown).

The combined squeegee bar assembly 9 of the prior art includes a squeegee element 15, typically made of rubber or the like, which includes a plurality of holes 17 for complementary mating engagement with the spaced prongs 19 of a lower squeegee bar 21. When mounted on the spaced prongs 19 of the lower squeegee bar 21, the squeegee element 15 rests upon the shoulders 23 associated with each spaced prong 19, in order to space the squeegee element 15 upwardly from the lower squeegee bar 21. Each of the spaced prongs 19 are also complementary mated within suitable prong receptacles (not shown) of the upper spacer bar 25, when the upper and lower spacer bars 21, 25 are complementary mated and assembled relative to the squeegee element 15. Following such assembly, the combined squeegee bar assembly 9 is inserted into the open portion 7 of the elongated U-shaped nozzle housing 3. In order to securely retain the combined squeegee bar assembly 9 within the open portion 7 of the elongated U-shaped nozzle housing 7, the upper squeegee bar 25 has spaced male locking sections 27, 27 which are complementary mated with corresponding female locking sections 29, 29 of the elongated U-shaped nozzle housing 3. In this way, the combined squeegee bar assembly 9 is retained within the open portion 7 of the elongated U-shaped nozzle housing 3, in order to operate as a wet nozzle for use with a vacuum cleaner (not shown).

As compared with the FIG. 1 prior art construction, the snap together wet nozzle of the present invention shown in FIGS. 2–6 of the drawings enjoys numerous features and advantages over such prior art design, while retaining some of the more common or generic elements, as will be understood.

The snap together wet nozzle 31 of the present invention also includes an elongated U-shaped nozzle housing 33 of different shape having closed ends 35, 35, an open side or bottom 37 and a closed side or top 39, the latter tapering upwardly from the closed ends 35 to a tubular element 41 for association with a vacuum cleaner (not shown). The tubular element 41 communicates with the open side or bottom 37 of the U-shaped nozzle housing 33, in order to enable air and water to pass around a squeegee element and through the tubular element 41, when drawn therethrough by the vacuum cleaner (not shown).

As distinct from the FIG. 1 prior art construction, the snap together wet nozzle 31 includes a single locking squeegee bar 43 for releasably holding and locking an elongated squeegee element 45. The locking squeeze bar 43 is constructed for releasably holding and locking the elongated squeegee element 45 between the locking squeegee bar 43 and the elongated U-shaped nozzle housing 33. For this purpose, the locking squeegee bar 43 has a plurality of spaced squeegee prongs 47 for reception within spaced complementary configured openings 49 in the elongated squeegee element 45, also preferably made from a rubber or like material.

It should be noted that the elongated squeegee element 45 is symmetrical in shape, that is, the complementary shaped openings 49 are formed equidistant from the sides and the ends of the elongated squeegee element 45, enabling the elongated squeegee element to be assembled relative to the spaced prongs 47 of the locking squeegee bar 43, without the need to orient the elongated squeegee element 45 in any particular manner.

Figure 2:
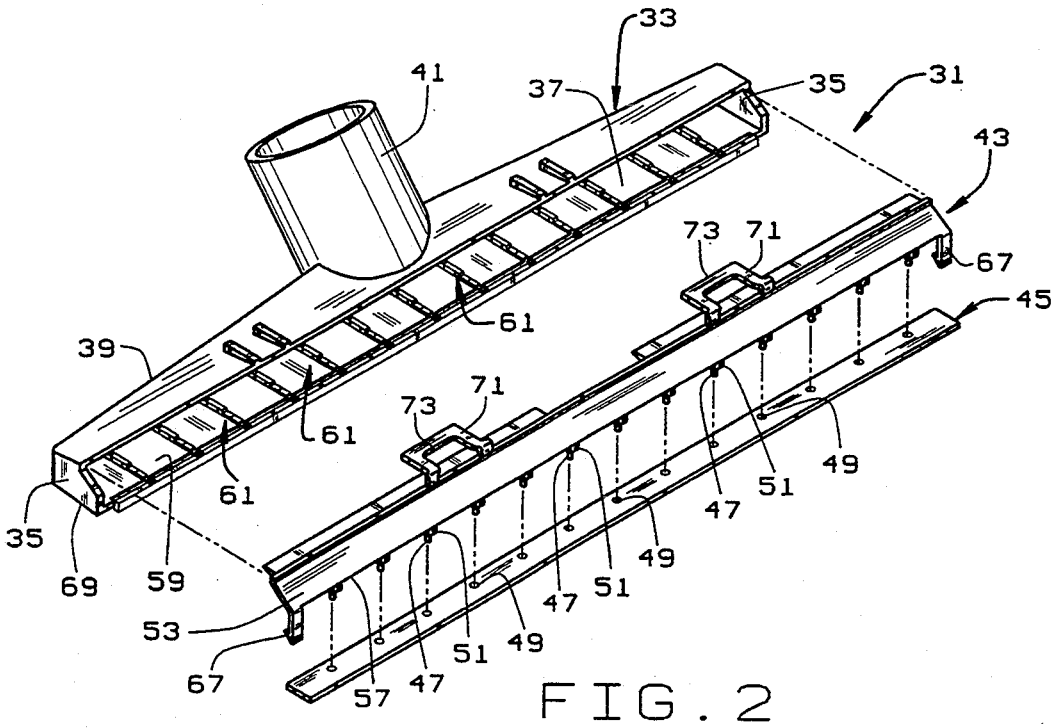
FIG. 2 is an exploded perspective view of the snap together wet nozzle construction of the present invention.
Figure 3:
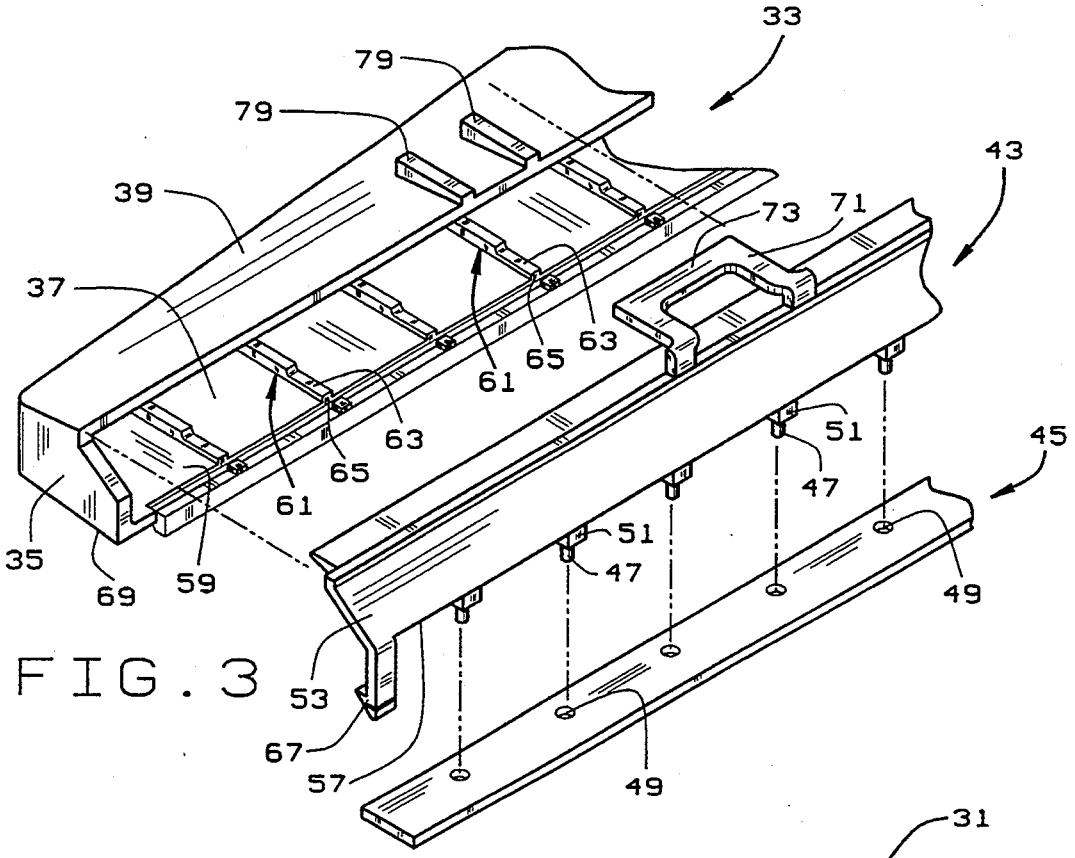
FIG. 3 is an enlarged exploded fragmentary perspective view of the snap together wet nozzle of the present invention.

Each of the spaced prongs 47 are integrally connected to shoulders 51, which are integrally connected to the downwardly tapered section 53 of the locking squeegee bar 43, as best seen in FIGS. 2–3 of the drawings. The shoulders 51 provide an opening 55 (see FIG. 6) between the squeegee element 45 and the lowermost edge 57 of the downwardly tapered section 53, allowing air and water to pass through the opening 55 and the tubular element 41, when drawn therethrough by a vacuum cleaner (not shown).

Figure 5:
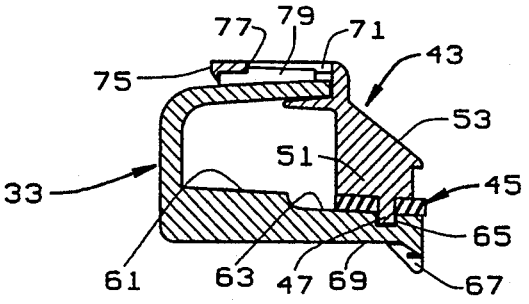
FIG. 5 is a sectional view of the snap together wet nozzle as viewed along line 5—5 of FIG. 4.

In order to releasably hold and lock the elongated squeegee element 45 between the locking squeegee bar 43 and the elongated U-shaped nozzle housing, an inner wall 59 of the elongated U-shaped nozzle housing 33 extends beyond the elongated U-shaped nozzle housing 33 and includes a plurality of spaced steps/receptacles 61 which cooperate with the elongated squeegee element 45 and the spaced prongs 47 of the locking squeegee bar 43. Each of the spaced steps/receptacles 61 are best seen in FIG. 3 of the drawings and include a step 63 for receiving the lower face of the elongated squeegee element 45 and a spaced prong receptacle 65, in alignment with each step 63, for receiving the spaced prongs 47 of the locking squeegee bar 43. This is best illustrated in FIG. 5 of the drawings where the elongated squeegee element 45 is captured between the locking squeegee bar 43 and the elongated U-shaped nozzle housing 43, through the spaced prongs 47 which are positioned within the spaced prong receptacles 65, while the lower face of the elongated squeegee element 45 is resting on the steps 63 of each of the spaced steps/receptacles 61.

Figure 4:
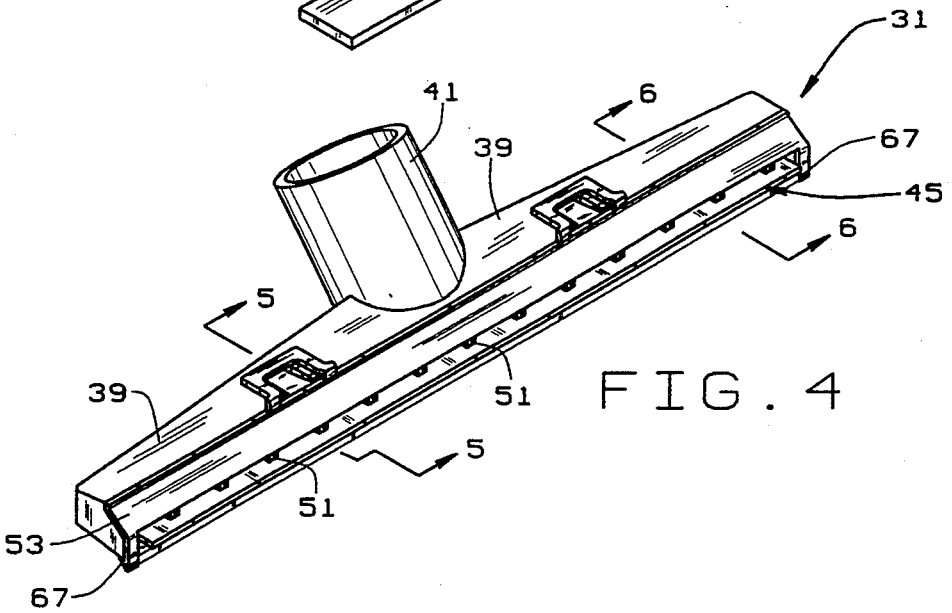
FIG. 4 is a perspective view of the snap together wet nozzle when assembled.
Figure 6:
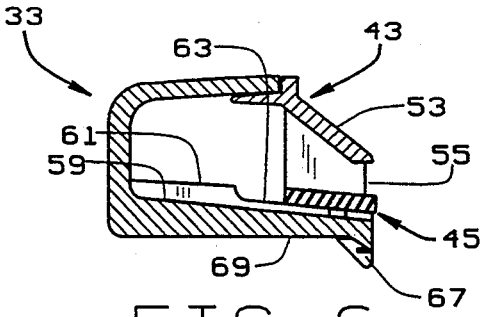
FIG. 6 is another sectional view of the snap together wet nozzle as viewed along line 6—6 of FIG. 4.

Each of the locking squeegee bar 43 and the elongated U-shaped nozzle housing 33 have complementary releasable locking means for releasably locking same with respect to one another. More specifically, the locking squeegee bar 43 has hook portions 67 which extend downwardly from the tapered section 53 of the locking squeegee bar 43 at opposite ends thereof. The spaced hook portions 67 underlie an outer wall 69 of the elongated U-shaped nozzle housing 33 on opposite ends of the elongated squeegee element 45, as best seen in FIGS. 4–6 of the drawings. These hook portions 67 and the outer wall 69 of the U-shaped nozzle housing 33 form lower locking elements which cooperate with upper locking elements in the form of spaced or U-shaped latches 71 which are integrally connected to and extends generally transverse relative to the locking squeegee bar 43. The bight or end portion 73 of each U-shaped latch 71 includes a downwardly shaped hook portion 75 which engages a rear face 77 associated with spaced pairs of ramps or cam elements 79. Thus, as the U-shaped latch 71 of the locking squeegee bar 43 is moved relative to an associated pair of ramps or camming elements 79, 79, the bight end portion 73 of the U-shaped latch 71 is cammed upwardly to create a resilient or spring biased action for the U-shaped latch 71. Once the hook portion 75 is positioned past the ramps or cam elements 79, 79 for engagement with the rear surface 77 thereof, the resilient or spring biased U-shaped latches 71 will releasably hold and lock the elongated squeegee bar 43 relative to the elongated U-shaped nozzle housing 33, while the spaced prongs 47 extend through the holes 49 of the elongated squeegee element and are received within the spaced prong receptacles 65 along the inner wall 59. Thus, the cooperation between the lower locking elements (hook portions 67 and outer wall 69) and the upper locking elements (spaced U-shaped latches 71 and the ramps or cam elements 79, 79) provides releasable locking engagement between the locking squeegee bar 43 and the elongated U-shaped nozzle housing 33, as will be apparent.

The inner wall 59 is shown as being tapered from the closed side or top 39 to the open side or bottom 37, thus providing a wider working angle or opening 55 between the squeegee element 45 and the locking squeegee bar 43.

It is a relatively easy matter to assemble the locking squeegee bar 43 and associated elongated squeegee element 45 relative to the elongated U-shaped nozzle housing 33. Once the mold cycle for the elongated U-shaped nozzle housing 33 is completed, the assembled locking squeegee bar 43 and associated elongated squeegee element 45 can be readily assembled to the elongated U-shaped nozzle housing 33, in the manner described above. This simplifies the assembly process during manufacture, and also makes apparent the ease with which the elongated squeegee element 45 can be replaced, by simply disassociating the locking squeegee bar 43 relative to the elongated U-shaped nozzle housing 33.

From the foregoing, it will now be apparent that the new and improved snap together wet nozzle of the present invention is constructed to provide a front loading elongated squeegee element insert, through an associated squeegee locking bar while utilizing a minimum number of parts. The ease of assembly and disassembly is greatly facilitated, while providing a wider working angle or opening for the operation of the snap together wet nozzle.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

We claim:

1. A snap together wet nozzle for use with a vacuum cleaner comprising:

an elongated U-shaped nozzle housing with closed ends including a connecting tube passageway for association with the vacuum cleaner;

an elongated squeegee element mounted within the elongated U-shaped nozzle housing;

a squeegee bar for releasably holding and locking the elongated squeegee element between the locking squeegee bar and the elongated U-shaped nozzle housing;

said squeegee bar having a plurality of spaced squeege spaced complementary configured openings in said elongated squeegee element, the plurality of spaced squeegee prongs being cooperatively engaged by a plurality of spaced prong receptacles formed in said elongated U-shaped nozzle housing along one inner wall surface of said U-shaped nozzle housing; and locking means associated with said elongated U-shaped nozzle housing and squeegee bar to provide said snap together nozzle.

2. The snap together wet nozzle as defined in claim 1 including spaced steps formed along the inner wall of the nozzle housing adjacent to and in alignment with the spaced prong receptacles for supporting the elongated squeegee element away from the inner wall surface of the nozzle housing containing the spaced prong receptacles.

3. The snap together wet nozzle as defined in claim 2 and further including shoulders associated with each of said spaced prongs for supporting the elongated squeegee element away from the locking squeegee bar.

4. The snap together wet nozzle as defined in claim 1 wherein the complementary releasable locking means of said [locking' squeegee bar cooperatively engage complementary releasable locking means of said elongated U-shaped nozzle on opposite spaced outer walls thereof.

5. A snap together wet nozzle for use with a vacuum cleaner, comprising:

an elongated U-shaped nozzle housing with closed ends including a connecting tube passageway for association with the vacuum cleaner;

an elongated U-shaped nozzle housing with closed ends including a connecting tube passageway for association with the vacuum cleaner;

an elongated squeegee element mounted within the elongated U-shaped nozzle housing;

a squeegee bar including a plurality of spaced prongs for reception within complementary configured openings in the elongated squeegee bar, the plurality of spaced prongs also being cooperatively engaged by a plurality of spaced prong receptacles formed along one inner wall surface of the elongated U-shaped nozzle housing; and complementary releasable locking means associated with said elongated U-shaped nozzle housing and said squeegee bar and associated elongated squeegee element relative to said elongated U-shaped nozzle housing to provide said snap together wet nozzle.

6. The snap together wet nozzle as defined in claim 5 including spaced steps formed along the inner wall surface of the nozzle housing adjacent to and in alignment with the spaced prong receptacles for supporting the elongated squeegee element away from the inner wall surface of the nozzle housing containing the spaced receptacles.

7. The snap together wet nozzle as defined in claim 5 and further including shoulders associated with each of said spaced prongs for supporting the elongated squeegee element away from the locking squeegee bar.

8. The snap together wet nozzle as defined in claim 5 wherein the complementary releasable locking means includes upper and lower locking elements which engage each other along outer walls of said elongated U-shaped nozzle housing.

9. The snap together wet nozzle as defined in claim 8 wherein at least the upper locking elements include resilient releasable locking means.

* * * * *